US010000303B2

(12) United States Patent
Malcolm

(10) Patent No.: US 10,000,303 B2
(45) Date of Patent: Jun. 19, 2018

(54) CONTAINER COMPRISING INTEGRAL FILM LID

(71) Applicant: DIRECT PACK, INC., Sun Valley, CA (US)

(72) Inventor: Christian Damian Malcolm, Thousand Oaks, CA (US)

(73) Assignee: Direct Pack, Inc., Azusa, CA (US)

( * ) Notice: Subject to any disclaimer, the term of this patent is extended or adjusted under 35 U.S.C. 154(b) by 177 days.

(21) Appl. No.: 15/042,606

(22) Filed: Feb. 12, 2016

(65) Prior Publication Data

US 2016/0236837 A1 Aug. 18, 2016

Related U.S. Application Data

(60) Provisional application No. 62/116,074, filed on Feb. 13, 2015, provisional application No. 62/180,331, filed on Jun. 16, 2015.

(51) Int. Cl.
*B65D 43/16* (2006.01)
*B65B 51/10* (2006.01)

(52) U.S. Cl.
CPC ..... *B65B 51/10* (2013.01); *B65D 43/162* (2013.01); *B65D 2543/0024* (2013.01);
(Continued)

(58) Field of Classification Search
CPC ..... B65B 51/10; B65D 43/162; B65D 2543/00296; B65D 2543/00314;
(Continued)

(56) References Cited

U.S. PATENT DOCUMENTS 2,887,244 A 5/1959 Betner
3,272,422 A 9/1966 Miller
(Continued)

FOREIGN PATENT DOCUMENTS

CA 1307240 C 9/1992
CA 1320920 C 8/1993
(Continued)

OTHER PUBLICATIONS

Written opinion and International Search Report for PCT application No. PCT/US2016/017739.
(Continued)

*Primary Examiner* — James N Smalley
(74) *Attorney, Agent, or Firm* — Frost Brown Todd LLC

(57) ABSTRACT

A container of the present invention may include a base, a lip extending around the periphery of the base, a perforation defined by the lip, and a lid adhered to the lip, wherein the lid includes a first undercut, wherein the first undercut overlaps the perforation. The perforation and undercut allow for a portion of the lid to remain on the lip after the lid has been opened. The portion remaining on the lid may include an outwardly facing adhesive surface, configured to adhere to the lid to reseal the lid to the base once the lid is closed after the initial opening. As such, the lid is permanently adhered to a first portion of the lip and resealably adhered to a second portion of the lip. The first portion may be an outer lip portion and the second portion may be an inner lip portion.

16 Claims, 9 Drawing Sheets

(52) U.S. Cl.
CPC ..... *B65D 2543/00101* (2013.01); *B65D 2543/00268* (2013.01); *B65D 2543/00296* (2013.01); *B65D 2543/00314* (2013.01)

(58) Field of Classification Search
CPC .. B65D 2543/00268; B65D 2543/0024; B65D 2543/00101; B65D 2101/0015; B65D 77/2024
USPC ..... 220/266, 270, 276, 359.1–359.4
See application file for complete search history.

(56) References Cited

U.S. PATENT DOCUMENTS 4,474,304 A 10/1984 Jacobs
4,674,650 A 6/1987 Hamilton et al.
4,858,780 A 8/1989 Hewlings
4,896,775 A 1/1990 Boeckmann et al.
4,905,838 A 3/1990 Suzuki et al.
4,913,306 A 4/1990 Piltz
4,949,527 A 8/1990 Boeckmann et al.
5,118,002 A 6/1992 Sugiyama et al.
5,334,405 A 8/1994 Gorlich
5,437,386 A 8/1995 Von Holdt
5,911,334 A 6/1999 Helms
5,971,231 A 10/1999 Samz et al.
5,996,882 A 12/1999 Randall
6,047,878 A * 4/2000 Lowry ..... B65D 3/262 220/258.2
6,056,141 A 5/2000 Navarini et al.
6,135,304 A * 10/2000 Wyslotsky ..... B65D 43/0272 220/276
6,352,170 B1 3/2002 Brown et al.
6,364,113 B1 4/2002 Faasse, Jr. et al.
6,648,140 B2 11/2003 Petricca
6,739,113 B1 5/2004 Kocher et al.
6,786,329 B2 9/2004 Onishi
6,918,532 B2 7/2005 Sierra-Gomez et al.
7,073,680 B2 7/2006 Boback et al.
7,118,003 B2 10/2006 Sellari et al.
7,344,744 B2 3/2008 Sierra-Gomez et al.
7,568,589 B2 8/2009 Vovan
7,631,776 B2 12/2009 Vovan et al.
7,712,626 B2 5/2010 Vovan
7,832,586 B2 11/2010 Vovan
7,913,870 B2 3/2011 Vovan
7,963,413 B2 6/2011 Sierra-Gomez et al.
7,992,743 B2 8/2011 Vovan
8,028,851 B2 10/2011 Vovan et al.
8,056,716 B2 11/2011 Fonteyne et al.
8,056,750 B2 11/2011 Vovan
8,083,089 B2 12/2011 Vovan
8,114,451 B2 2/2012 Sierra-Gomez et al.
8,123,064 B2 2/2012 Vovan
8,127,961 B2 3/2012 Vovan
8,146,766 B2 4/2012 Vovan et al.
8,251,242 B2 8/2012 Vovan
8,251,249 B1 8/2012 Vovan
8,308,363 B2 11/2012 Vogt et al.
8,322,555 B2 12/2012 Chen
8,360,262 B2 1/2013 Vovan
8,365,910 B2 2/2013 Valaie et al.
8,523,000 B2 9/2013 Vovan
8,672,166 B2 3/2014 Nazareth et al.
8,684,217 B2 4/2014 Bruehl et al.
8,722,122 B2 5/2014 Vogt et al.
8,746,483 B2 6/2014 Sierra-Gomez et al.
8,795,580 B2 8/2014 Sellari et al.
8,833,589 B2 9/2014 Vovan
8,851,315 B2 10/2014 Vovan
8,889,205 B2 11/2014 Sierra-Gomez et al.
8,951,591 B2 2/2015 Vogt et al.
8,985,334 B2 3/2015 Mays et al.
8,998,030 B2 4/2015 Minnette et al.
2003/0183637 A1 10/2003 Zappa et al.
2004/0118852 A1 6/2004 Barmore et al.
2005/0189353 A1 9/2005 Padovani
2007/0023435 A1 2/2007 Sierra-Gomez et al.
2007/0131687 A1* 6/2007 Otto ..... A47G 33/002 220/212
2008/0087669 A2 4/2008 Boback et al.
2009/0120942 A1 5/2009 Vovan
2009/0250466 A1 10/2009 Fujimura
2010/0230411 A9 9/2010 Sierra-Gomez et al.
2010/0278454 A1 11/2010 Huffer
2011/0204054 A1* 8/2011 Huffer ..... B65D 77/2036 220/266
2013/0047559 A1 2/2013 Minnette
2013/0199956 A1 8/2013 Hunter et al.
2013/0300028 A1* 11/2013 Naber ..... B29C 45/006 264/242
2014/0069922 A1 3/2014 Boback et al.
2014/0217100 A1 8/2014 Nazareth et al.
2014/0300034 A1 10/2014 Sellari et al.
2014/0367383 A1 12/2014 Sellari et al.
2014/0373330 A1* 12/2014 Vanmechelen ..... B65D 43/162 29/428
2015/0028033 A1 1/2015 Samuel
2015/0060456 A1 3/2015 Vovan
2015/0083717 A1 3/2015 Sullivan et al.
2015/0096991 A1 4/2015 Vanmechelen
2015/0158631 A1 6/2015 Mays et al.
2016/0207670 A1* 7/2016 Chou ..... B65D 43/0235

FOREIGN PATENT DOCUMENTS

CA 2261199 A1 12/1994
CA 2166947 A1 7/1996
CA 2197959 A1 8/1998
CA 2453694 A1 6/2004
CA 2463215 A1 10/2004
CA 2553501 A1 2/2007
CA 2595659 A1 2/2008
CA 2599296 A1 6/2008
CA 2709173 A1 8/2009
CA 2702331 A1 10/2010
CA 2811008 A1 3/2012
CA 2565664 A1 4/2012
CA 2533236 A1 10/2014
GB 2175282 A 11/1986
WO WO 2004/060767 A1 7/2004
WO WO 2010/010130 A2 1/2010
WO WO 2015/072404 A1 5/2015

OTHER PUBLICATIONS

Inline Plastics Corp.; Patent Issued for Tamper Evident Containers; Journal of Engineering (Feb. 27, 2013) 3071.
Placon News; Placon Introduces New Line of Tamper Evident Deli Containers Made with 100% Recycled PETE; May 18, 2012.

* cited by examiner

CONTAINER COMPRISING INTEGRAL FILM LID

This application claims priority to: U.S. Provisional Patent Application No. 62/116,074 entitled, "Container Comprising Integral Film Lid," which was filed on Feb. 13, 2015; and U.S. Provisional Patent Application No. 62/180,331 also entitled "Container Comprising Integral Film Lid" which was filed on Jun. 16, 2015.

TECHNICAL FIELD

The present disclosure relates to containers and packaging, and more particularly, to containers and packaging that incorporate: both single piece hinged and non-hinged containers, (clamshells/tubs) and two piece containers (tubs and lids) comprising locking or resealing features.

BACKGROUND

Disposable containers for packaging, distributing, displaying or otherwise housing consumer items, especially perishable foods, are becoming increasingly important. Historically, perishable products were brought to market and sold quickly to avoid loss due to exposure to natural elements causing ripeness and eventual decay.

The advent of plastics resulted in many products being wrapped or packaged in plastic, both in the form of flexible plastic bags and solid plastic containers. The use of plastics in the modern-day convenience food industry has significantly improved the "shelf life" of perishable products, allowing both merchants and their customers to store the products for longer periods of time, resulting in substantial savings, and greater distribution.

In addition, consumers may prefer to visually inspect the food product within such containers prior to purchase. Thus, fabricating containers from clear see-through plastics is desirable. For example, packaging provided for bakery goods or agriculture products has often been in the form of clear, plastic clamshell packaging, because, among other things, such clear, plastic clamshell packaging, provides a baked-on-the-premises or homegrown image that grocery retailers have found to be especially appealing to consumers.

Typically, plastic containers will include a fairly rigid lid and base, although they may be subject to some amount of flexure. Ideally, the lid should be capable of properly and effectively sealing the container, yet the container should be constructed so that the lid is relatively easy to remove, and in some circumstances, replace, since it may be expected that the container and lid would be reused. In addition, the lid should provide adequate space for product branding and meeting regulatory product identification (e.g., identification of the product, place of product origin, weight, etc.) in the form of a label that may comprise paper, plastic or both. Typically, these containers are either pre-labeled or labeled after the product is filled in a secondary application.

The advancement in the aforementioned types of containers has significantly increased availability of healthy food options, and decreased the cost and spoilage of fruits and vegetables; however, their existence has also increased the amount of rigid plastic present in our waste stream each year. The amount of non-recycled rigid plastic containers has reached epidemic levels, and has led to many cities and states in North America and Europe creating new recycling guidelines and laws both restricting use and attaching monetary penalties for over use.

It has been found that viable options to reduce the amount of rigid plastic used each year are few, relatively expensive, and often impractical taking into consideration the initial capital investment in equipment needed to execute the conversion. In addition, these solutions have often lacked re-closeable features resulting in comestible products becoming dried out, especially in circumstances where more than one serving of a comestible product is contained therein. Moreover, these solutions have failed to allow stacking of the containers within consumer refrigerators.

To address these problems, one solution has been to utilize "lidding" film. Lidding film may seal a rigid container without requiring the use of a rigid lid. For example, lidding film is currently used to seal microwaveable dinners in a rigid container. However, such use of lidding film is characterized by a number of problems. For example, the equipment needed to heat seal film to a rigid container may cost hundreds of thousands of dollars, and typically runs at half the speed of current rigid automated closure lines. Another disadvantage of using lidding film is that it is typically not resealable. Moreover, it is very expensive to ventilate lidding film and align the resulting perforations to increase the breathability of comestible products in the container. In light of the foregoing, utilizing lidding film, particularly in the fresh food industry, would be difficult and costly.

Another example of a film-based solution is the flow wrap bag. For more than a decade, European produce companies have used the flow wrap bag as a combination of rigid elements combined with film elements as a wrapping solution. When compared to a traditional clamshell of similar shape and size, the flow wrap bag results in the reduction of rigid plastic utilization. However, this solution is characterized by its own disadvantages, including but not limited to, the fact that the film bag requires an automated machine for application and once opened cannot be closed like a rigid container.

Each of the aforementioned solutions lacks any rigid structure within their film components, and as such, the act of resealing or closing may be difficult. Moreover, unsupported films may convey a cheap or flimsy feel to the consumer. Based at least upon the foregoing, use of film components with rigid structures would seem to be undesirable for companies seeking to preserve their brand name and the perceived value of the food products within.

Although each of the two solutions mentioned above may be used for a centralized processing facility, or a single growing footprint or region, there are considerable limitations and disadvantages when utilizing these film-based solutions across a large growing footprint, such as across North America and/or Europe. The major disadvantage to these types of solutions is the machinery needed to apply the film. It simply isn't practical or cost effective to transport expensive machinery from one growing region to another, which might require growers to have multiple machines in place and running as one growing region is winding down and another is just starting to produce. Produce items must be packaged quickly, transported to coolers to preserve freshness, and then shipped to retail within hours, so flexibility and speed are critical.

The current preferred non-film packaging solution is the single piece hinged clamshell, and although effective and less costly then the film solution, it adds millions of extra pounds of plastic to the waste stream each and every year. Additionally, these hinged containers are prone to popping open at retail, often resulting in slip and fall accidents as fruit like tomatoes and blueberries roll across produce isles. As a result, many retailers have made it mandatory for growers to apply a secondary tape application across the lid and base of a container to ensure that the container won't inadvertently pop open. Yet, these hinged containers often pop open on automated packing lines just prior to the tape station causing expensive shut downs and restarts of packing equipment and scales.

Thus, there is a compelling interest in the development of containers having: consumer-preferable design elements such as: tamper evidence sealed containers that don't pop open recloseability features that are reliable and easy to operate, that use a considerably less plastic and that remain friendly to pack, stack, close and open.

BRIEF DESCRIPTION

The present disclosure meets the aforementioned needs, while also improving upon, and solving problems associated with, previous containers by providing, among other things, a resealable film lid/lock technology, which may be integral to the container, and which may relate to the replacement and therefore removal of rigid lid structures as closure features of plastic containers.

BRIEF DESCRIPTION OF THE DRAWINGS

While the specification discloses certain aspects of the present invention, it is believed the same will be better understood from the following description taken in conjunction with the accompanying drawings in which.

DETAILED DESCRIPTION

The present disclosure meets the aforementioned needs, while also improving upon and solving problems associated with previous containers by providing, among other things, a re-sealable film lid/lock technology, which relates to the replacement and therefore removal of rigid lid structures as closure features to plastic containers.

In an exemplary embodiment of the invention, the container is comprised of two separate components brought together to act as one package, a rigid base and a flexible film lid.

I. Rigid Base

Containers according to the present disclosure comprise a rigid base. Non-limiting examples of useful rigid bases include currently marketed clamshell bases or tub bases. Such clamshell bases or tub bases may comprise: a flat or ribbed bottom, rigid side walls, a vented or non-vented base and/or side walls, ribbed or smooth wall structures intended for structural integrity as well as clear visibility of product, and combinations thereof. Rigid bases according to the present disclosure may differ from current clamshell and tub bases, since the rigid structure comprises a unique rim structure; this rim structure is designed to work in conjunction with the film lid (described below), and to act as a unitary package.

The unique rim structure may take any suitable shape or size, and may comprise a series of perforations running along the rim of the container, and may further comprise a rigid pull tab corner or center. The perforations may be of any suitable length, pattern, or shape, so long as they provide a means to tear at least a portion of the rim structure away from the rigid base, either along a portion of, or along the entire, rim area. Without wishing to be bound by theory, the purpose of the perforated section or perforated entire rim is to rip away from the base when the consumer lifts up from a portion of the rim, e.g., a specific corner such as a tab corner, of the container, so as to provide a rigid structure or skeleton frame to the film lid, which is otherwise sealed onto the container rim.

Figure 1:
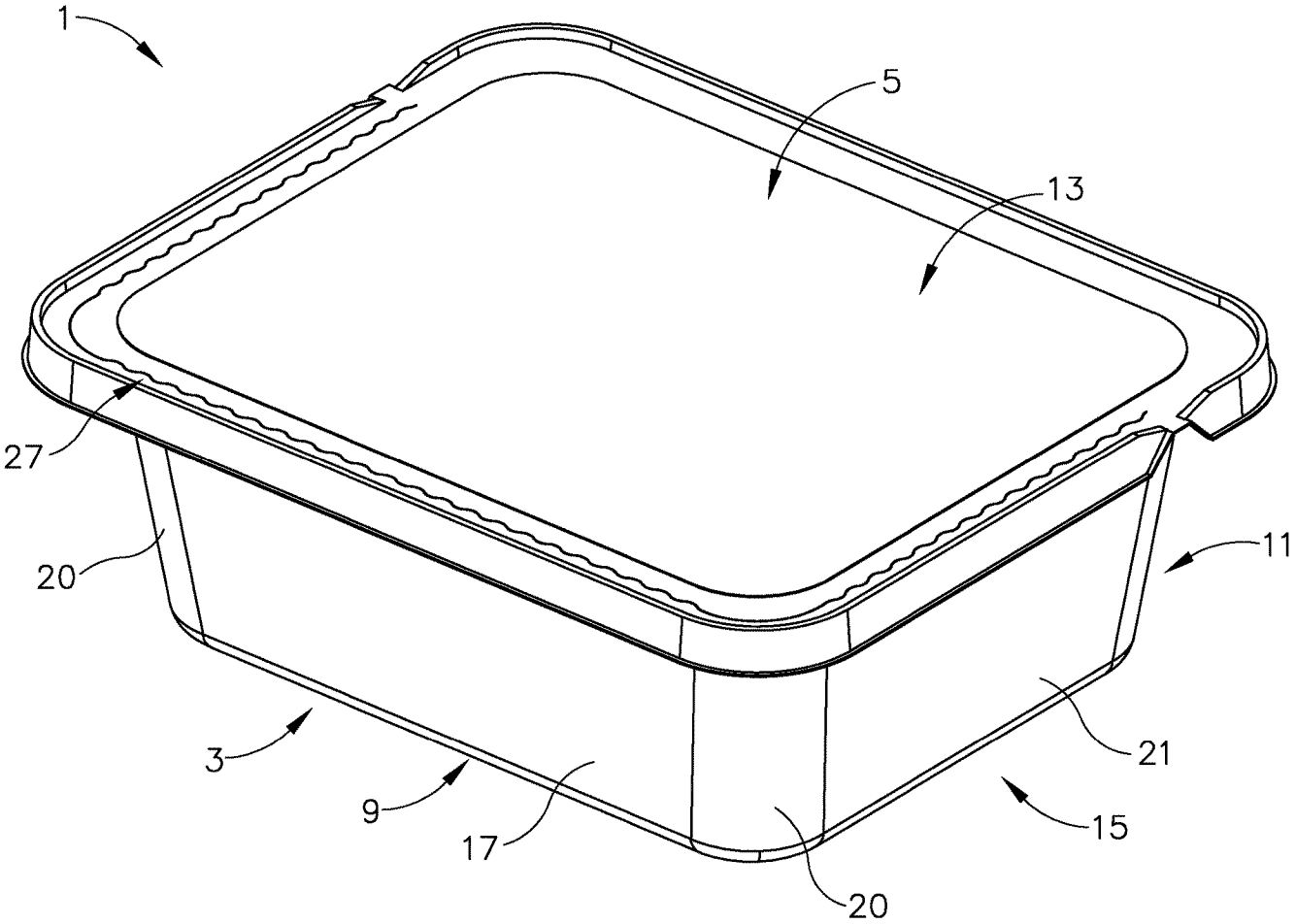
FIG. 1 is a perspective view of an embodiment of a container comprising an integral, hinged film lid per the present disclosure and in a closed position.
Figure 2:
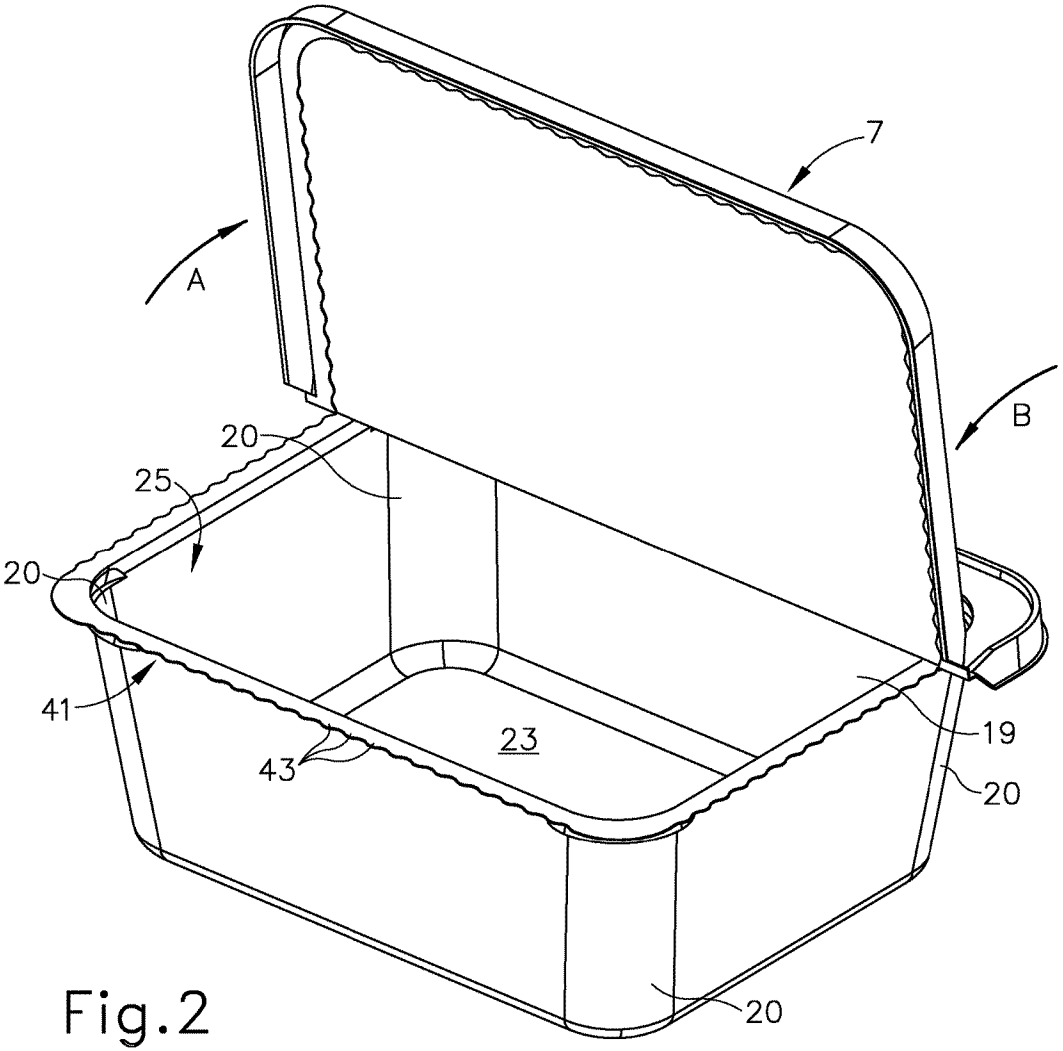
FIG. 2 is a perspective view of the container of FIG. 1 with the lid in an open position.
Figure 3:
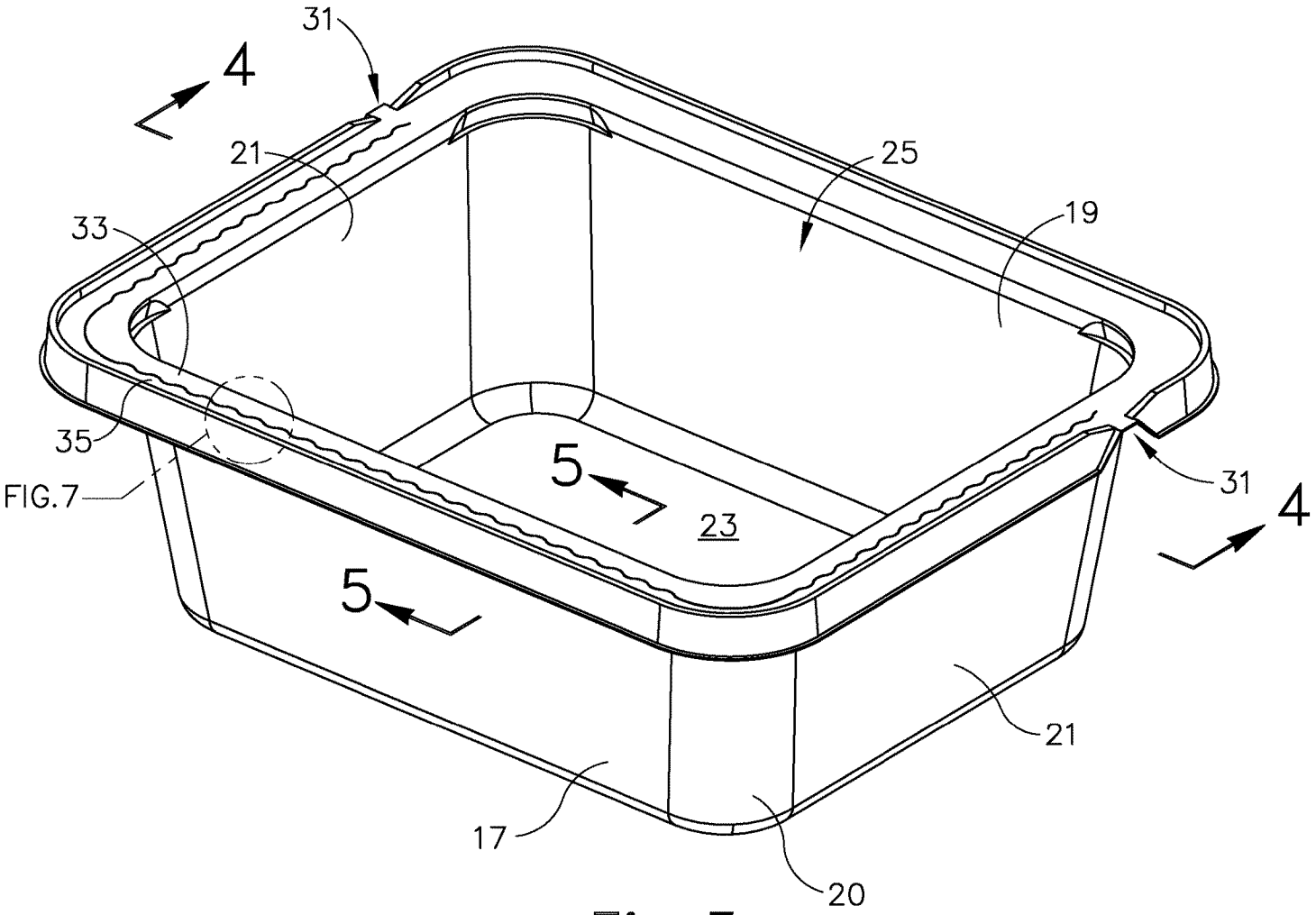
FIG. 3 is a perspective view of the container of FIG. 1 with a film element of the lid removed.
Figure 4:
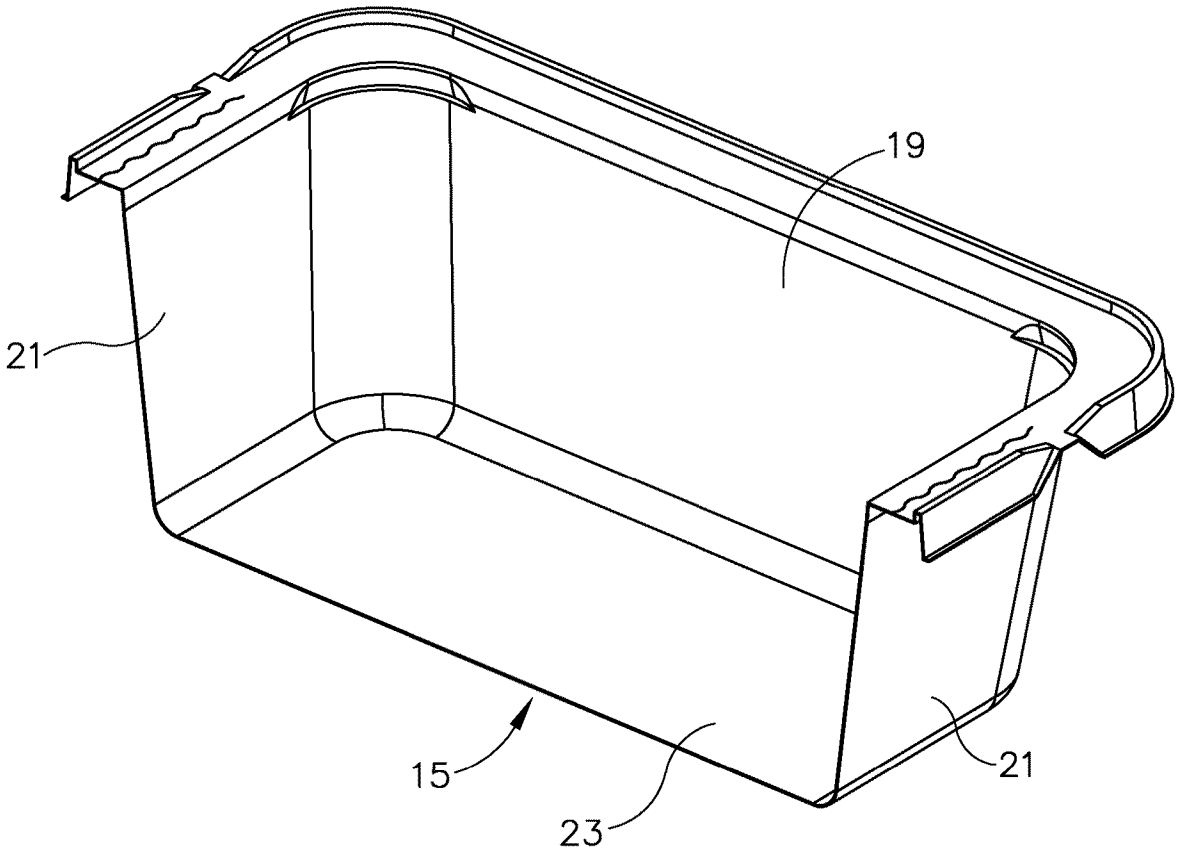
FIG. 4 is a cross-sectional view taken along line 4-4 of FIG. 3.
Figure 5:
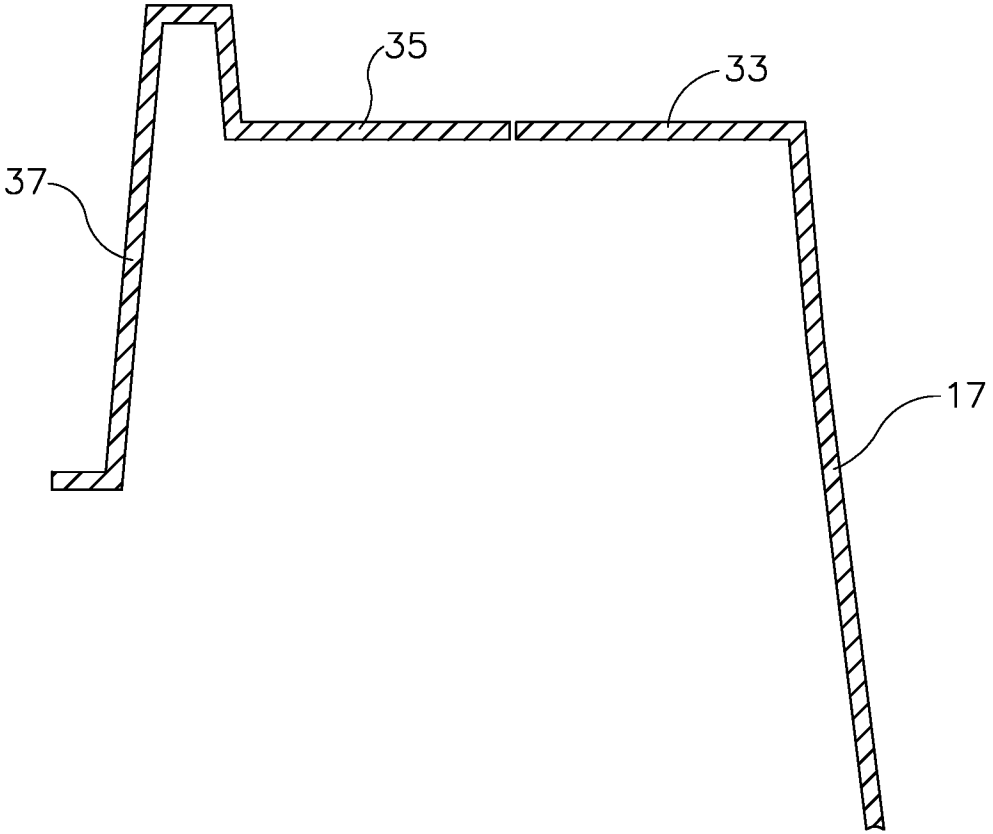
FIG. 5 is a cross-sectional view taken along line 5-5 of FIG. 3.

The rigid structure or skeleton frame is designed to either flip open and hinge along the rim base at the end of the perforations on either side of the container thus creating both a flexible and rigid flip lid structure (as shown in FIGS. 1 and 2), or it can be completely separated into two pieces, the rigid base, and a flexible lid with a skeleton rigid frame (not shown). These two embodiments may provide growers and processors two separate options when packaging fresh produce, processed fruits and vegetables, or other food products. For example a personal single-serve salad bowl with a generic two piece plastic container, a tub and lid, may now be converted into a one piece tub with a perforated rim and a flexible film lid applied by an automated application method. The uniqueness of the present embodiments may also include the desirable feature of the film not being required to separate from the tub rim frame at any time thus reducing any possible tears or the need of applying a heavier gauge film structure to act as a lid.

II. Film Lid

The film lid may have a structure comprising single or multiple layers of film. The structure is designed to act as a rigid lid and to replace all of its intended purposes. The film lid may be printed prior to assembly to the base, such as with product branding, product information including but not limited to, state and federal regulations of product, identifiable product codes and combinations thereof. Printing of the film may desirably eliminate the need for paper labels entirely as the film lid now becomes the label as well. After printing and die cutting of the film it may be wound onto rolls for automatic application to the base structure. Non-limiting examples of film application methods include: a roller-based action pinching of the film to the flat perforated area of the rigid base utilizing a semi-permanent adhesive as the bond, and/or a tamp-on air cylinder actuating plate method which acts by pushing or attaching the film to the perforated rim area of the container by applying pressure to the container.

Figure 8:
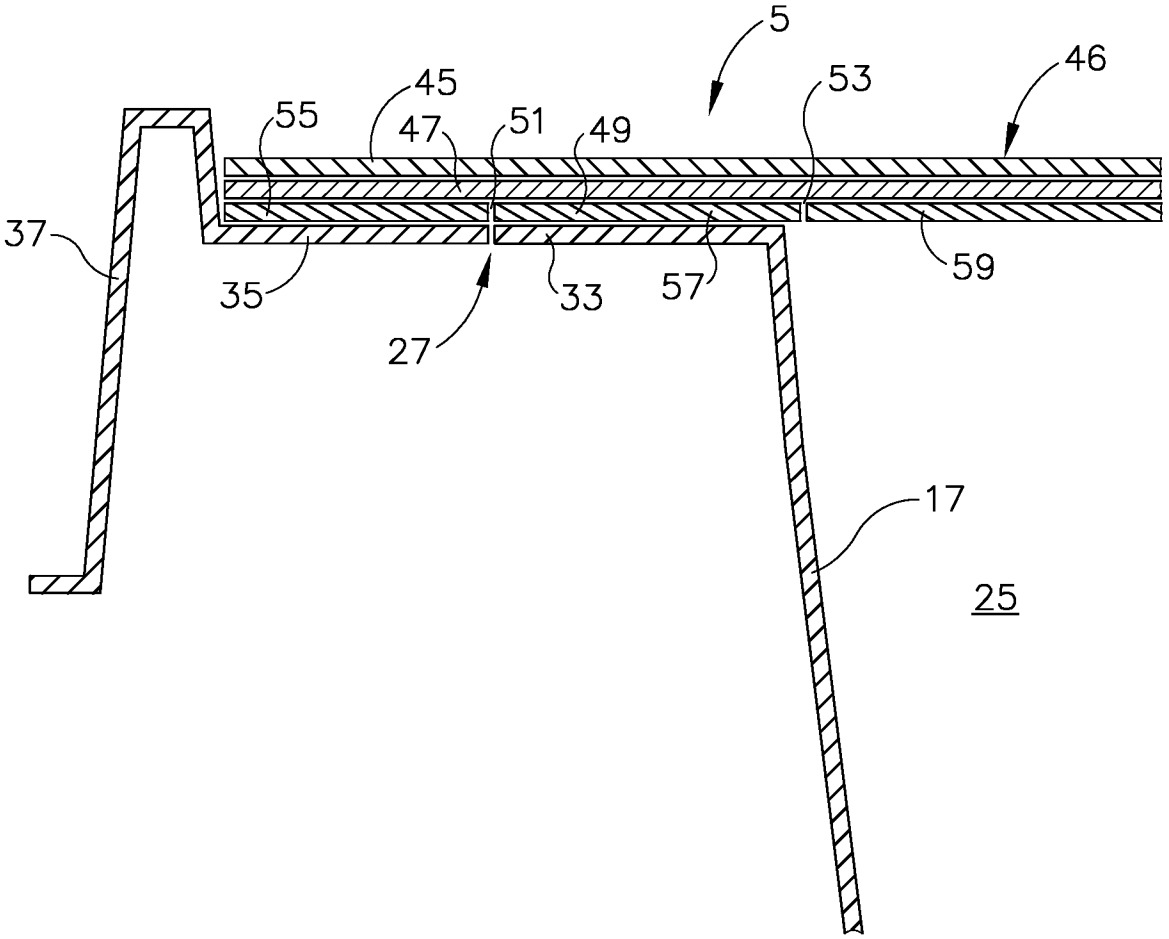
FIG. 8 is a cross-sectional view similar to FIG. 5, with the additional elements of a film or face stock layer, an adhesive layer, and a heat seal liner layer.

The film structure may be sealed to both sides of the perforated area on the rim of the container with a semi-permanent adhesive bond; with a primary seal and a secondary seal (see for example FIG. 8). In some embodiments, the primary seal or secondary seal may comprise either an adhesive layer or a heat seal liner layer. The primary seal is bonded to the outer most portion of the perforated area called the skeleton or frame while the secondary seal is applied to the remaining rim still attached to the base. The primary seal is the largest sealing area and may allow the entire film structure to be lifted off with the skeleton or frame while the secondary smaller sealing area is primarily used to re-secure the lid film frame back onto the base when the container is closed again. Each of the primary and secondary seal rim areas may be specifically designed for the shape and size of each rigid base to ensure that it will adequately reclose.

The design features of the present container embodiments may mimic those of a rigid clamshell or a two piece container without the need for the rigid lid, thus reducing the overall plastic weight by 35-40% and additionally eliminating the need for paper labels.

The film lid may be specifically designed for its corresponding base container, and may be vented in a pattern or non-vented depending on the specific commodity intended for its use.

The rigid base and its film lid are intended to work in conjunction with one another when the film lid is attached to the rigid base through several attachment methods: film application through roller method, and/or a tamp-on applicator. In any case, the film structure may be pulled tight across the rim of the rigid base by the application method, and may result in a tight film lid capable of having multiple containers stacked on top of itself, such as during shipping, at retail, and in the consumer's home. Additional cut outs on the film may link up with male stacking posts on the rim to ensure that containers nest at retail whenever possible. The support stakes and matching lid film holes are also designed to release when pulled up and to re-lock when pulled down again creating a multi-use sealable stacking container.

The film liner may be comprised of one or more layers of any suitable film. Suitable films may include for example, film additive technology such as ethylene scrubbing technology or antifungal additives to further increase "shelf life" and product value. Use of such films eliminates the need for gluing expensive ethylene absorbent pads into the bottom of clamshells and/or tubs to increase "shelf life". Adding ethylene scrubbing technology to the bottom surface of the film lid may also be more effective in reducing ethylene levels within the package as ethylene is lighter than air and will naturally come in contact with the film liner structure as ethylene fills the container from the natural ripening of fruit.

The use of such a film as a lid and all its related properties may replace the need for: a hinged or two-piece rigid plastic solution, a base with a bag, or a lidding film with a tray; thus reducing the overall plastic in waste streams by as much as 35-40% without added cost and machinery. The overall reduction in plastic may impact waste streams by millions if not tens of millions of pounds of plastic. In addition, the film lid may be removed from the base of the container by pulling it from the base where it was adhesively sealed resulting in a 100% recyclable base without any labels or other material attached thereto, unlike current labeled rigid containers.

A. Flexible Film Structure

FIGS. 1-9 illustrate an embodiment of a flexible film having a printable face stock layer of variable material thickness, a liner stock or layer of variable material thickness, and a layer of adhesive of various types and functionality sandwiched in between. Accordingly, product information can be directly printed onto the face stock layer of the film. During the manufacturing process, dies and vacuum components create primary and secondary die cuts. The primary die cuts the roll of film to match or correspond to the perimeter of the base of the container. In some embodiments, the base includes a raised ridge to hide the film beneath the raised ridge. In this embodiment, the film is cut slightly smaller to fit within the ridge line. The secondary die cuts an internal cut on the bottom layer of the liner to separate the liner from the remaining roll of film so that the liner is attached to the face stock by the adhesive layer. The secondary cut is slightly larger than the inside perimeter of the base of the container such that the product stored within the container does not contact the adhesive. The label structure has a liner or carrier layer that dispenses the leading edge of the face stock onto its corresponding leading edge of the rigid base by means of an automated application method and conveyor system. After the face stock separates from the liner via a peel plate, it exposes the internal adhesive layer directly onto the base rim. As the base moves further down the conveyor system the label is peeled off the roll and leads into a secondary die cut on the liner that covers the product and creates a barrier layer between the product and the adhesive layer. As the outside liner is on a continuous feed pulling the label across the base, it seals the base from front to back with a ring of adhesive corresponding to the rigid base sealing rim area. A small gap in between labels on the roll sets up the process again as the next base is positioned at the application site. Accordingly, the flexible film can be used with any shape of base.

B. Re-Sealable Film

An embodiment of a re-sealable flexible film may include a printable face stock of variable material thickness, a liner stock or layer of variable material thickness, and a layer of adhesive of various types and functionality sandwiched in between. In this embodiment, the adhesive area comprises a locking adhesive zone and a re-seal zone. The locking adhesive zone includes an adhesive that can be applied to the skeleton frame of the base to hold this portion of the flexible film with the frame. The re-seal zone includes an adhesive that can be applied to a flange of the base such that this portion of the flexible film can be pulled away from the flange of the base to open the container and then repositioned on the flange of the base to re-seal the container. In some instances, the container is air-tight and/or liquid-tight when the container is re-sealed.

In addition, the adhesive layer of the present embodiment is weight bearing to allow a plurality of containers to be stacked on top of each other. Vertical stacking strength may be needed for these containers to be nested on top of each other either in shipping, while stacked at retail displays or stacked within the consumer's home refrigerators. The weight bearing adhesive component of the label structure can be of a variable thickness, a family of adhesives both direct and indirect food grade contact materials, and of various viscosities in cold temperatures. The strength of the adhesive layer may vary depending on the product used with the containers.

For example, a container with a weight bearing load of under 1 lb. may function and process differently than a container with a weight bearing load of greater than 1 lb. The containers may be differentiated by size, shape, sealing area, purpose, processing, application speeds, retail display configurations, shelf space formats, etc. Products that contain less than 1 lb. are traditionally single serve or limited use containers that may or may not contain juice or liquid. The weight of the product inside generally helps to differentiate the purpose of the container, film structure, and adhesive layer needed. For example, a container with 6 ounces of washed and ready to eat grapes that contains a small amount of liquid may need to be air and water tight during the short consumption window after opening, whereas containers with more than 1 lb. of washed and ready to eat grapes may be enjoyed over time such that the container may need to be air and water tight for a greater length of time and after each opening and closing of the container. With that noted, smaller containers may have smaller weight bearing loads versus larger weight bearing containers designed to be used over time. Because adhesive layers of increasing thickness may cost more than a thinner layer of the adhesive, it may be desirable to apply a layer of adhesive with the minimum thickness needed for a given application to reduce packaging costs on the smaller single serve containers.

Products that are not ready to eat and are generally larger than 1 lb. function primarily as a serve as needed container. An example of this would be 2 lbs. of field asparagus. Consumers typically do not eat or cook these larger amounts of product at one time and may want these containers to be sealed again and again after the initial dispensing of product, so a resealable indirect food grade adhesive may be needed. When the container is designed to be air and water tight at time of packing, the container may also be air and water tight when it is re-sealed after opening to ensure that the product does not dry out, leak, or have a considerable loss of shelf life.

To accomplish such a wide and varying spectrum of products and applications, products can be classified into separate categories of adhesives that match corresponding products and weight bearing specifications. During the product development stages of each package, a sufficient adhesive solution is determined for the specific application needed. Once the type of adhesive is identified and the shape of the container is determined, specialized dies and screens may be created to produce the unique pattern or adhesive zones needed for the package. Generally these adhesives zones include two sections, the outer most lock seal that adheres to the skeleton frame of the base, and an inner most re-sealable adhesive zone that is adhered to the re-seal flange on the remaining base of the container. These zones can be created by several means, including but not limited to, applying separate adhesive zone layer on press via plates similar to applying color or deadening a solid adhesive layer with a screen or plate to reduce the aggressive adhesive into a re-sealable adhesive on the inner ring. Additionally or alternatively, heat can be passed through the face stock and the adhesive layer to seal the heat seal film to the rim of the base to create a seal that can hold weight. Accordingly, the flexible film can be used with any shape of base.

III. Method of Manufacturing and Using a Container

A printing press may be used to print information on the face stock layer of the flexible film. The clear face stock is designed to replace the need for all paper or plastic branding and product info labels. Rolls are printed with a high graphic printing press and die cut to the shape and size of the container. Prior to the application of the flexible film, the film may be printed with several key product codes, trace information, QR Codes, and any other product information or origin of product needed to meet regulatory demands. A plain BOPP face stock may be printed directly with ink or an imprintable varnish may be used as a top coat to enable a thermal transfer process to print directly on the container. The ability to print a variable data trace number, origin of product, product specifications, and/or a QR Code, in addition to branding and product specifications, directly to the container at the time of sealing is a breakthrough. Currently containers are pre-labeled with such track and trace labels and these containers must be kept sequential in nature and cannot be mixed or changed, whereas printing directly onto the container's flexible film lid at the point of sealing changes the need for pre-labeling and storage of said containers. This breakthrough allows for manufacturers of products, growers, and food processors to automate their packing lines and their label capabilities all in one step. This process also eliminates any doubt as to when the product was labeled and printed with trace data, as the product is now printed at the time of sealing and not at a packaging company months earlier and stored prior to packing.

The structure of the pressure sensitive label being on rolls lends itself to several methods of high speed application. A rotary plate and/or rail application method may place each label on a rigid rim structure across the base of the containers to seal the containers. These applications may run at speeds of up to about 200 parts per minute. A label applicator system may be supported by support rails and a series of rollers that may apply the labels firmly onto the container's sealing area with a high degree of accuracy and pressure. Both of these application methods are designed to be about 6 feet in length and several feet wide and easily configured onto any high speed packing equipment or processing line.

A standard heat seal machine application method may also be used to place each label within a rigid rim structure across the base of the containers. In some instance, the heat seal machine may seal the containers at speeds of up to about 60 containers per minute. Any heat sealing machine may be used to seal the containers, but sealing plates designed to seal across a wider point or at two points may be used.

Figure 9:
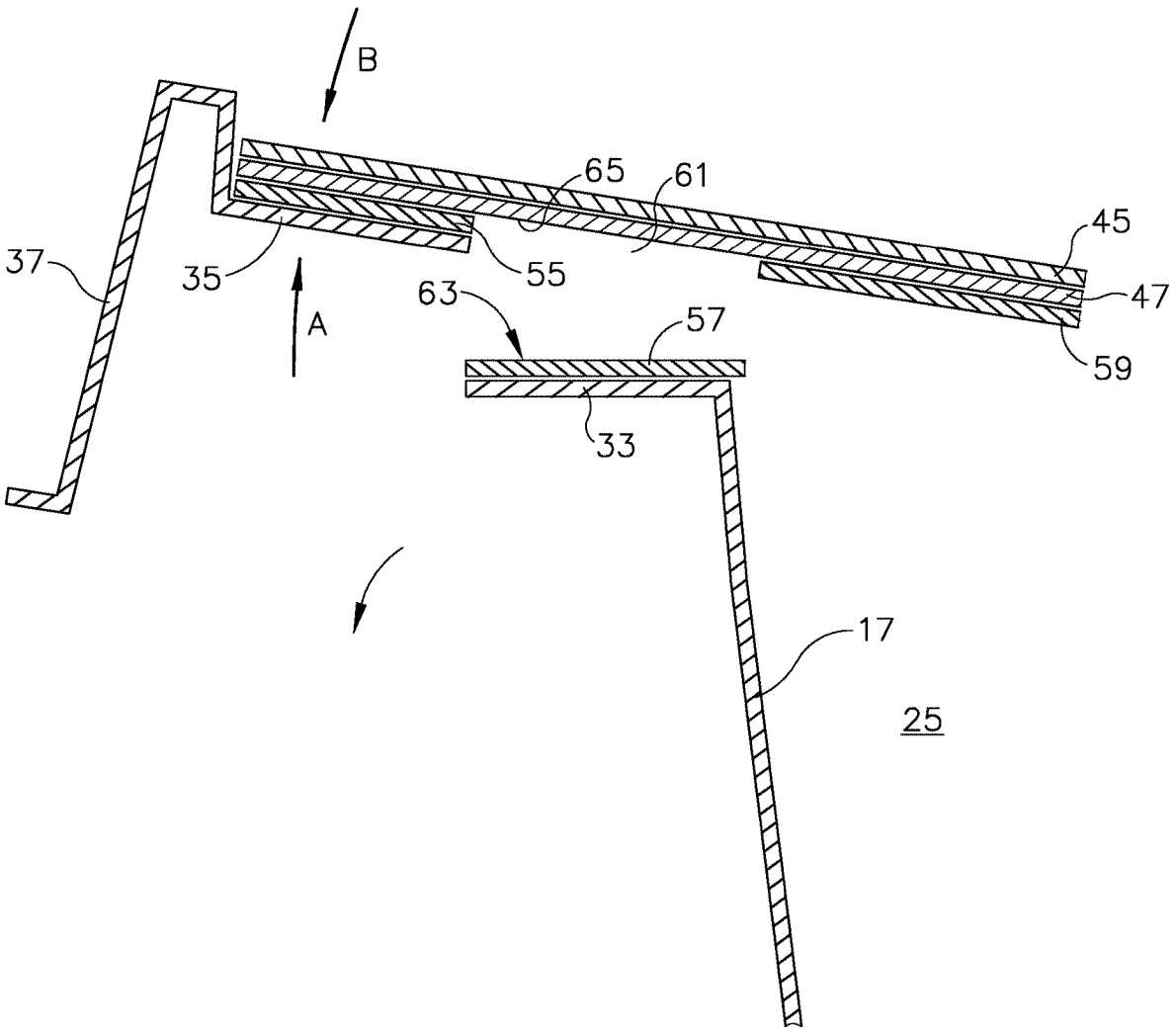
FIG. 9 is a cross-sectional view similar to FIG. 8, with the lid elements moved to an opened position.

In an embodiment of the invention, a container may be provided with the flexible film applied to the base of the container. The label structure has a printable face stock, a middle adhesive layer, and a heat seal liner or carrier layer. The face stock is printed and die cut on a label press; however, the application method is by any standard heat seal machine. The machinery components may comprise an infeed, a nesting canister with heat seal gasket ring, a sealing plate, film cutting station, and out feed. The combination of heat sealing the film structure to the base of the container eliminates possible slipping of the adhesive layer due to any interaction with silicone on the rigid base from weight bearing loads. In some instances, silicone is used as a slip agent to allow containers to separate when stacked inside each other. By only placing silicone on the bottom of the base of the container, a stronger seal may be obtained with the adhesive layer on the top portion of the base. The adhesive layer is positioned between the two film layers, until the perforated rim of the rigid base is broken when opened, as shown in FIGS. 8 and 9. Here, the skeleton frame of the base is lifted upward to break away from the re-seal flange of the base. As the skeleton frame breaks away, the heat seal liner also breaks away such that a portion of the heat seal liner remains secured to the skeleton frame and a portion of the heat seal liner remains secured to the re-seal flange. This exposes the adhesive layer aligned with the re-seal flange such that the adhesive layer can be re-sealed with the heat seal liner positioned on the re-seal flange. Undercuts on the heat seal liner may be a continuous cut or a perforated cut line, as shown in FIG. 1.

Perforations may be made as undercuts on the bottom of the rim of the container so that when the container is opened, any sharp edges where the rim and lid separate are in an area that do not come into contact with a consumer's hand. For instance, as shown in FIGS. 8 and 9, the skeleton frame of the base of the container comprises a lip that overhangs a portion of the side wall of the base. Perforations are then cut between the skeleton frame of the base and the re-seal portion of the base. In the illustrated embodiment, the perforations are cut in a wave pattern, but any other suitable pattern may be used. When the container is opened, the skeleton frame of the base separates from the re-seal portion of the base. The exposed nicks from the breaks in the perforations are positioned on the skeleton frame of the base, under the overhang and away from the consumer's hands. The re-seal portion of the base includes hidden nicks from the perforations so that the consumer does not contact any sharp edges.

FIGS. 1-9 show an embodiment of a container comprising an integral, hinged film lid. As shown, the base of the container may comprise one or a plurality of recesses having various shapes and sizes to simultaneously accommodate various products within the container. Any suitable number of recesses may be used and the recesses and/or the base may comprise any shape and/or size. The base further comprises a skeleton frame with perforations extending along a front of the base to the sides of the base. It should be noted that the perforations of the base can extend along any portion of the base to create an opening for the container, and may extend along the entire portion of the base to create a separate lid. In the illustrated embodiment, the base comprises a living hinge at the end of the perforations. Accordingly, when the skeleton frame is pulled away from the re-seal flange of the base, the living hinge allows the skeleton frame and the film to be rotated about the living hinge to open the container. This allows the container to include hinge capabilities along any angle or radius. The lid may then be lowered to re-seal the flexible film with the re-seal flange of the base with the adhesive layer of the film. The flexible film may further be re-sealed to the central portions of the base between the recesses.

In some instances, the base and/or the flexible film of the container can be vented in macro and/or micro venting patterns. Each pattern or venting structure is designed to meet either the cooling specifications or respiration rates of the product within. Almost all food products can have their shelf life extended by the means of reducing cooling times, or controlling the flow of respiration and oxygen transfer rates between the product and its surrounding environment. The venting structure is intended to mimic the venting specifications of a standard rigid container with either a clamshell or two piece structures.

In some embodiments, the skeleton frame of the base comprises a corner of the base. For instance, an embodiment of the invention may include a base and film lid having perforations cut transversely across a corner of the base. The remaining portion of the rim of the base provides a re-seal portion with the adhesive layer. Accordingly, a user may grasp the corner of the container having the perforations and pull upwards on the corner. This may cause the perforations to separate to allow the corner of the base to separate with the remaining portion of the base and pull the film lid away from the base of the container to open the container. The corner of the base thereby remains with the film of the container and may provide tamper evidence. If desired, the film lid can be re-sealed with the remaining portion of the rim of the base by pressing the film lid against the rim to re-secure the adhesive layer with the base.

In the illustrated embodiment, the perforations are provided in a wave pattern. Accordingly, when the corner of the base is lifted to separate the skeleton frame with the remaining portion of the base, the corner of the base comprises hidden nicks from the perforation separation underneath the film such that the nicks do not contact a user's hand. The remaining base portion then has a smooth cut without any nicks. While FIGS. 1-9 show the perforations as being cut in a substantially wave pattern, any other suitable shape may be used.

In some embodiments of the present disclosure, a container comprises a film lid and locking rigid base system for a one-piece open faced tub container that has a tamper evident tear away rim skeleton frame supporting the film lid structure.

In some embodiments of the present disclosure, the film lid has a face stock layer, a liner, and an adhesive layer positioned between the face stock layer and the liner.

In some embodiments of the present disclosure, product or label information is printed onto the face stock layer.

In some embodiments of the present disclosure, the liner includes a heat seal liner that is secured to the skeleton frame of the base.

In some embodiments of the present disclosure, the base of the container includes a re-seal flange that is selectively couplable with the adhesive layer of the film to allow the container to be opened and re-sealed.

In some embodiments of the present disclosure, the base includes perforations between the skeleton frame and the re-seal flange of the base.

In some embodiments of the present disclosure, the skeleton frame of the base includes an overhang to conceal any exposed nicks formed between the perforations.

In some embodiments of the present disclosure, the base includes a plurality of recesses.

In some embodiments of the present disclosure, the base includes a living hinge to allow the skeleton frame and the film to rotate about the living hinge to move the container between an open position and a closed position.

In some embodiments of the present disclosure, the container is vented.

In some embodiments of the present disclosure, the film is applied to the base of the container using a rotary plate application.

In some embodiments of the present disclosure, the film is applied to the base of the container using a rail application.

In some embodiments of the present disclosure, the film is applied to the base of the container using a heat seal machine.

In some embodiments of the present disclosure, the skeleton frame comprises a corner of the base.

An embodiment of the present disclosure may include a container comprising a base defining a chamber with a lip extending around the periphery of the base. The container may include a plurality of perforations defined by the lip, wherein the perforations define an outer lip portion of the lip and an inner lip portion of the lip, and wherein the inner lip portion is disposed between the outer lip portion and the chamber. The container may also include a lid, wherein the lid is permanently adhered to the outer lip portion of the lip, and wherein the lid is resealably adhered to the inner portion of the lip. In this particular embodiment the lid may comprise a liner layer comprising a first portion and a second portion and a first undercut defined therebetween with the liner layer is permanently adhered to the lip. The lid may also comprise an adhesive layer, wherein the adhesive layer is permanently adhered to the inner lip portion, and wherein the adhesive layer is resealably adhered to the outer lip portion. The resealable adherence allows the outer lip portion to move away from the lip as part of the lid and to allow a user to open the container.

As shown in FIGS. 1-9, the invention may be embodied by a container 1. Container 1 generally comprises a base assembly 3 coupled with a lid assembly 5, with portions of the base assembly 3 and lid assembly 5 combining to form a lid 7 (FIG. 2) when a user opens container 1.

Base assembly 3 includes a front side 9, a rear side 11, a top side 13, and a bottom side 15. Base assembly 3 further includes a front wall 17, a rear wall 19, and two opposed sidewalls 21 extending therebetween. Base assembly 3 further includes a set of four chamfered corners 20 where each sidewall 21 meets the front wall 17 and the rear wall 19. Chamfered corners 20 reinforce the walls and provide stability for container 1, particular when other similar containers are stacked on top of container 1. A bottom wall 23 extends between one end of each of the front wall 17, the rear wall 19, and the sidewalls 21. Front wall 17, rear wall 19, sidewalls 21, and bottom wall 23 cooperate to define an interior chamber 25 therebetween. Interior chamber 25 is configured to receive an item or items therein, such as produce or other edible foodstuffs. The nature of the items may be of the sort that may be eaten or removed in pieces or stages, such that a resealable containment of chamber 25 would be beneficial.

Each of front wall 17, rear wall 19, and sidewalls 21 extend from bottom wall 23 to a peripheral lip 27 encircling the interior chamber 25. Lip 27 includes a plurality of perforations 29 extending between a pair of hinge areas 31 of lip 27. The plurality of perforations 29 generally separate lip 27 into an inner lip portion 33 and an outer lip portion 35, referred to hereinafter as inner lip 33 and outer lip 35. Lip 27 may further include a profiled edge 37 at the outermost peripheral portion of the lip 27. In an embodiment of the invention, profiled edge 37 may include the various horizontal and angled segments shown in FIG. 5. However, profiled edge 37 may be configured to have any shape, may be applied only to a portion of the periphery of lip 27, or may be omitted altogether from lip 27.

Figure 6:
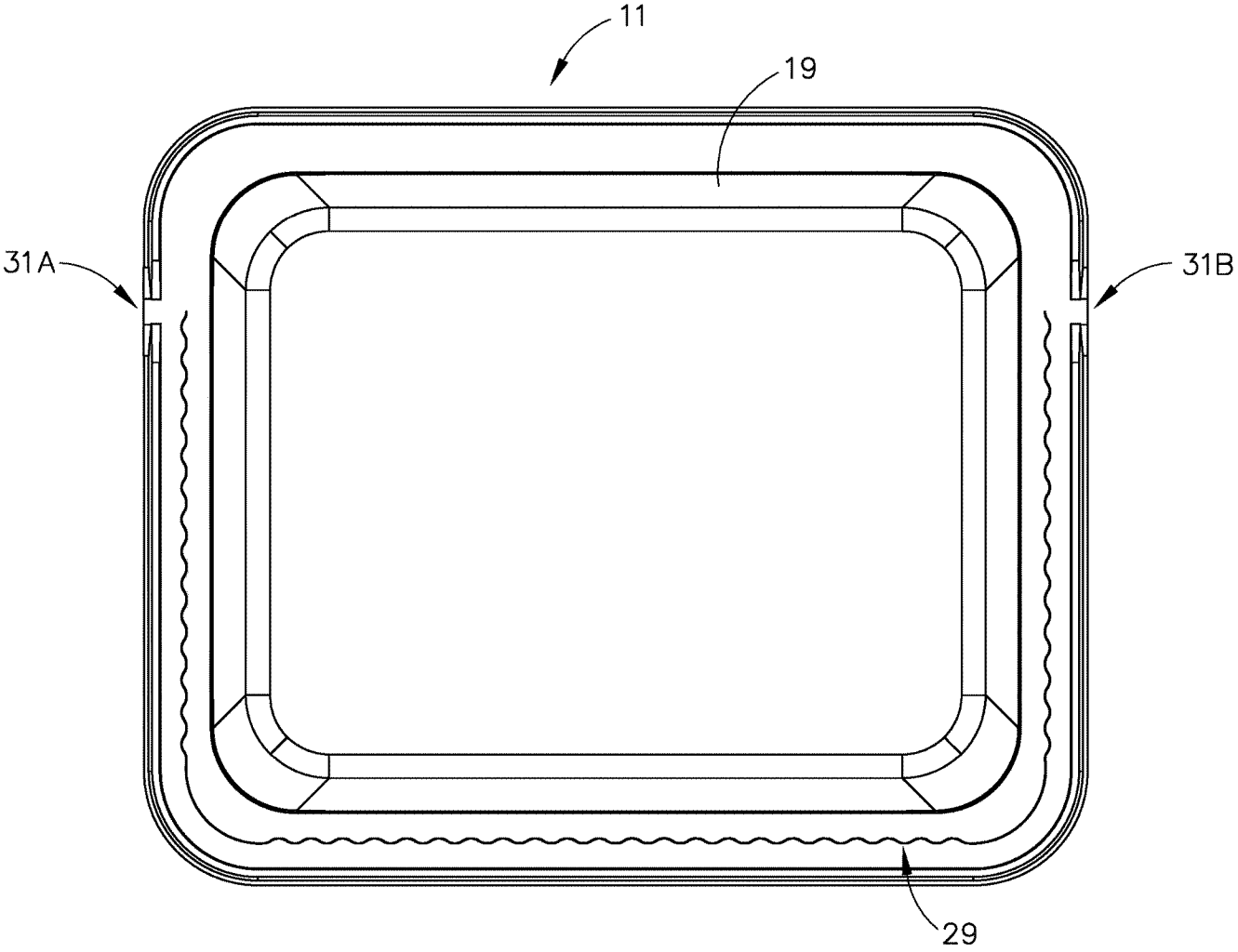
FIG. 6 is a top view of the container of FIG. 3.
Figure 7:
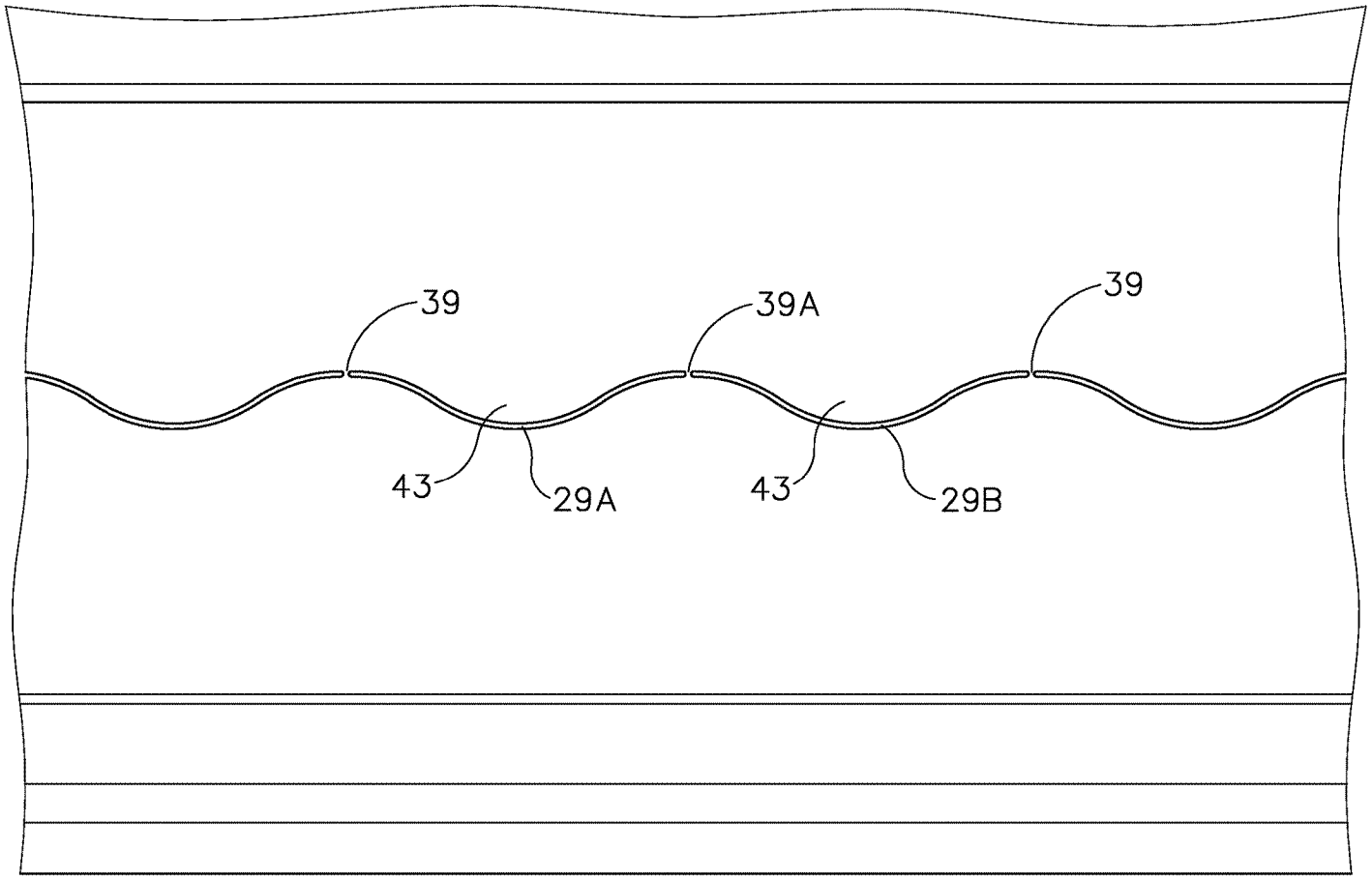
FIG. 7 is an enlarged view of a portion of the container of FIG. 3.

As shown in FIGS. 1, 6, and 7, peripheral lip 27 is generally flat and horizontally oriented when container 1 is resting on a horizontal surface. The plurality of perforation 29 extend around approximately three-fourths of the lip 27, extending from a first location, such as hinge area 31A (FIG. 6) to a second location, such as hinge area 31B (FIG. 6). Perforations 29 may be formed in a pattern or non-linear configuration, such as a curved, serpentine, or sinusoidal wave shape. As shown in FIG. 7, perforation 29A extends generally the distance of one wave length of a sinusoidal wave shape. A series of corresponding attachment sections 39 are disposed generally between each perforation 29 and act to stabilize container 1 and hold inner lip 33 to outer lip 35 before container 1 is first opened by a user. Attachment sections 39 are generally aligned with the terminating portion of two adjacent perforations 29 to facilitate and coordinate breaking the attachment section 39 along the path of the perforations 29. For example, attachment section 39A is disposed between perforation 29A and perforation 29B. As pressure is applied to outer lip 35, attachment section 39A breaks or tears along the path of perforation 29A and perforation 29B. The destruction of attachment section 39A connects the two perforations and merges perforation 29A and perforation 29B into a single elongated perforation.

Attachment sections 39 act as a tamper evident element of container 1. This tamper evident element provides visual feedback to a user or owner as to whether the container 1 has been previously opened or tampered with based on whether each attachment section 39 is intact.

As shown in FIGS. 2 and 7, after attachment sections 39 are destroyed and outer lip 35 is lifted away from inner lip 33, a non-linear rim 41 is exposed. Non-linear rim 41 includes a series of protrusions 43. Protrusions 43 are primarily defined by the shape of the perforations 29 include a corresponding rounded shape. Non-linear rim 41 is textured or otherwise rounded to reduce the possibility of the user cutting a hand or finger, as an extended straight edge is eliminated by protrusions 43. As such, a user can grasp or run a finger along non-linear rim 41 without encountering a straight edge.

As shown in FIGS. 8 and 9, lid assembly 5 is resealably adhered to inner lip 33 and permanently adhered to outer lip 35. In an embodiment of the disclosure, lid assembly 5 generally includes three layers, a face stock layer 45, an adhesive layer 47, and a heat seal liner layer 49. The face stock layer 45 faces outwardly from chamber 25 as the outermost layer of lid assembly 5 when the container 1 is sealed and may comprise a thin film to reduce weight and waste. Face stock layer 45 includes an outer surface 46 and may include various indicia thereon to project information to the user. Face stock layer 45 may also include a series of vent holes (not shown) to provide adequate ventilation to the material contained in chamber 25, as required. A corresponding set of vent holes (not shown) may be provided in the base assembly 3 to allow flow of ventilation air through base assembly 3 and lid assembly 5 of container 1.

The adhesive layer 47 is formed from a strong adhesive disposed between face stock layer 45 and heat seal liner layer 49 to firmly bond face stock layer 45 to heat seal liner layer 49. Adhesive layer 47 is configured to be double sided, in that each side of adhesive layer 47 bonds with the adjacent material. As will be described in greater detail below, adhesive layer 47 is configured to permanently adhere to the liner layer 49 proximate the outer lip 35 and resealably adhered to the liner layer 49 proximate the inner lip 33.

As shown in FIG. 8, the heat seal liner layer 49 includes a first undercut 51 and a second undercut 53. First undercut 51 is generally vertically aligned or overlapping with one or more of the perforations 29 and second undercut 53 is generally disposed proximate front wall 17 along the front side 9 of container 1 and correspondingly, proximate side walls 21 on the outsides of container 1. First undercut 51 and second undercut 53 may be a linear cut following along the entire length of perforations 29, or one or both of first undercut 51 and second undercut 53 may be in a wave pattern similar to perforations 29 or may be in an interspersed or dashed pattern. First undercut 51 and second undercut 53 cooperate to divide heat seal liner layer 49 into a first portion 55, a second portion 57, and a third portion 59, with first undercut 51 overlapping one or more of the perforations 29.

As shown in FIGS. 2 and 9, as a user lifts lid 7 in the direction of Arrow A, second portion 57 of heat seal liner layer 49 separates from the first portion 55 and the third portion 59 and remains secured to inner lip 33 of peripheral lip 27. The absence of second portion 57 between first portion 55 and third portion 59 creates a pocket 61. Further, the separation of second portion 57 from first portion 55 and third portion 59 by moving lid 7 in the direction of Arrow A exposes an upper surface 63 of second portion 77 and a lower surface 65 of adhesive layer 47. Adhesive layer 47 is configured such that lower surface 65 retains a sticky adhesive quality, even after separation from second portion 57. As such, as lid 7 moves in the direction of Arrow B to close container 1, second portion 57 moves into pocket 61 and lower layer 65 adheres to upper layer 63, resealing container 1. Thus, a user may selectively open lid 7 to retrieve some contents or materials held in chamber 25 and thereafter close lid 7 to reseal the entire periphery of lip 27 because adhesive layer 47 is permanently adhered to first portion 55 and resealably adhered to second portion 57.

Resealably adhered means there exists a bonding or adherence, but the two elements may be pulled apart or otherwise selectively separated.

In operation, a user will grasp any convenient portion of peripheral lip 27, such as profiled edge 37 proximate front side 9 and pull upwardly in the direction of Arrow A (FIGS. 2 and 9). The pressure on outer lip 35 compared to inner lip 33 increases until attachment sections 39 break along each perforation 29, releasing outer lip 35 from inner lip 33 and forming lid 7. Thereafter, lid 7 is free to move about hinge area 31, which represents a change or omission in the structure of profiled edge 37 of peripheral lip 27 to allow for the movement of lid 7. Alternative, perforations 29 extend around the entire periphery of peripheral lip 27 and the lid 7 may be entirely separated from base assembly 3. The opening of lid 7 exposes the protrusions 43 of non-linear rim 41, which presents a bumpy, textured, or disjointed outer edge to the user, rather than a straight edge, to reduce the risk of injury.

As each attachment section 39 breaks and lid 7 is lifted in the direction of Arrow A, first undercut 51 and second undercut 53 allow second portion 57 of heat seal liner layer 49 to remain secured to inner lip 33. The broken attachment sections 39 provides immediate visual feedback as to whether container 1 has been tampered with and opened previously. If a grocer or other vendor who may be concerned with tampering observes one or more of the attachment sections 39 broken, the vendor may take action in the appropriate manner.

Once lid 7 is open, the user is free to retrieve any items within chamber 25 of container 1. If the user wishes to reseal container 1, the user moves the lid in the direction of Arrow B. As shown in FIG. 9, pocket 61 is formed in lid 7 and is sized to receive second portion 57 as lid 7 moves in the direction of Arrow B. Lower surface 65 of adhesive layer 47 retains adhesive qualities after separation from second portion 57. As lower surface 65 is brought into contact with upper surface 63 of second portion 57, these two portions adhere to one another and act to reseal lid 7 to base assembly 3.

The invention claimed is:

1. A container comprising:

a base defining a chamber;

a lip extending around the periphery of the base;

a plurality of perforations defined by the lip, wherein the perforations define an outer lip portion of the lip and an inner lip portion of the lip, and wherein the inner lip portion is disposed between the outer lip portion and the chamber; and a lid, wherein the lid is permanently adhered to the outer lip portion of the lip, and wherein the lid is resealably adhered to the inner portion of the lip, and further wherein, the lid comprises:

a liner layer comprising a first portion and a second portion and a first undercut defined therebetween, and wherein the liner layer is permanently adhered to the lip; and an adhesive layer, wherein the adhesive layer is permanently adhered to the inner lip portion, and wherein the adhesive layer is resealably adhered to the outer lip portion.

2. The container of claim 1, wherein the lip comprises a hinge disposed at a first location on the lip.

3. The container of claim 2, wherein the plurality of perforations extend from the first location.

4. A container comprising:

a base;

a lip extending around the periphery of the base;

a perforation defined by the lip, wherein the perforation separates the lip into an outer lip portion and an inner lip portion; and a lid adhered to the lip, wherein the lid includes:

a first undercut, wherein the first undercut overlaps the perforation;

a heat seal liner layer heat sealed to the lid, wherein the first undercut extends through the heat seal liner; and a second undercut, and wherein the second undercut extends through the heat seal liner.

5. The container of claim 4, wherein the heat seal liner layer comprises:

a first portion defined by the first undercut and heat sealed to the outer lip portion and;

a second portion defined by the first undercut and the second undercut and heat sealed to the inner lip portion.

6. The container of claim 5, wherein the lid further comprises an adhesive layer, wherein the adhesive layer is permanently adhered to the first portion of the heat seal liner layer, and wherein the adhesive layer is resealably adhered to the second portion of the heat seal liner layer.

7. The container of claim 6, wherein the second portion comprises an upper surface, wherein the adhesive layer comprises a lower surface, and wherein the upper surface of the second portion is resealably adhered to the lower surface of the adhesive layer.

8. The container of claim 7, wherein the lid further comprises a face stock layer adhered to the adhesive layer.

9. The container of claim 8, wherein the lip comprises a plurality of attachment sections, and wherein the perforation comprises a plurality of perforations.

10. The container of claim 9, wherein the plurality of attachment sections are interlaced with the plurality of perforations.

11. The container of claim 10, wherein the lid includes a plurality of vent holes, and wherein the base includes a plurality of vent holes.

12. A method of forming a container comprising:

applying a plurality of perforations to a peripheral lip of a base of a container to define an inner lip portion and an outer lip portion of the lip;

applying a liner layer of a lid to the inner lip portion and the outer lip portion of the lip;

applying a first undercut to the liner layer, wherein the first undercut overlaps at least a portion of the plurality of perforations; and heating the liner layer of the lid to seal the liner layer to the first lip portion and the second lip portion.

13. The method of claim 12, further comprising interlacing an attachment section between each projection in the plurality of projections.

14. The method of claim 13, further comprising providing a hinge proximate a first location on the lip, and wherein the plurality of perforations extend from the first location.

15. The method of claim 13, further comprising adhering an adhesive layer to the liner layer, wherein the adhesive layer is free of undercuts.

16. The method of claim 15, further comprising:

forming a vent hole in the lid; and forming a vent hole in the base.

* * * * *